US008006442B2

(12) United States Patent
Cheng et al.

(10) Patent No.: US 8,006,442 B2
(45) Date of Patent: Aug. 30, 2011

(54) DOUBLE-GLAZED WINDOWS WITH INHERENT NOISE ATTENUATION

(75) Inventors: Li Cheng, Hong Kong (CN); Deyu Li, Hong Kong (CN); Ganghua Yu, Hong Kong (CN)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 360 days.

(21) Appl. No.: 11/898,089

(22) Filed: Sep. 10, 2007

(65) Prior Publication Data

US 2009/0008185 A1 Jan. 8, 2009

Related U.S. Application Data

(60) Provisional application No. 60/929,549, filed on Jul. 2, 2007.

(51) Int. Cl.
*E06B 3/00* (2006.01)

(52) U.S. Cl. ..... 52/144; 52/204.5; 52/786.13

(58) Field of Classification Search ..... 52/144, 52/204.5, 204.593, 204.597, 204.6, 204.62, 52/204.69, 656.5, 204.591; 181/289, 284, 181/286

See application file for complete search history.

(56) References Cited

U.S. PATENT DOCUMENTS

| | | | | |
|---|---|---|---|---|
| 3,783,084 | A * | 1/1974 | Quenett | 428/34 |
| 3,875,706 | A * | 4/1975 | Okawa | 52/172 |
| 4,114,342 | A * | 9/1978 | Okawa | 52/786.13 |
| 4,542,611 | A * | 9/1985 | Day | 52/172 |
| 4,787,296 | A * | 11/1988 | Huang | 454/212 |
| 5,131,194 | A * | 7/1992 | Anderson | 52/144 |
| 5,290,611 | A * | 3/1994 | Taylor | 428/34 |
| 5,598,669 | A * | 2/1997 | Hamdi et al. | 52/144 |
| 6,021,612 | A * | 2/2000 | Dunn et al. | 52/144 |
| 6,116,375 | A | 9/2000 | Lorch et al. | |
| 6,151,396 | A | 11/2000 | Maier | |
| 6,231,710 | B1 | 5/2001 | Herup et al. | |
| 6,668,974 | B1 * | 12/2003 | Mottelet et al. | 181/284 |
| 6,957,516 | B2 | 10/2005 | Allaei | |
| 2006/0059801 | A1 * | 3/2006 | Allaei | 52/204.5 |

FOREIGN PATENT DOCUMENTS

EP 1698753 9/2006

OTHER PUBLICATIONS

The University of South Wales article "Helmholtz Resonance" dated Feb. 10, 2007—http://web.archive.org/web/20070210160034/http://www.phys.unsw.edu.au/jw/Helmholtz.html.*

* cited by examiner

*Primary Examiner* — Brian Glessner
*Assistant Examiner* — Adam Barlow

(57) ABSTRACT

The present invention relates to a noise attenuating window comprised of two panes of glass separated by a spacer tube. The spacer tube contains T-shaped acoustic resonator capable of targeting a single mode or multiple-mode to be attenuated.

5 Claims, 6 Drawing Sheets

DOUBLE-GLAZED WINDOWS WITH INHERENT NOISE ATTENUATION

BACKGROUND

Sound transmission through windows is one of the major noise sources in rooms. The challenge for noise transmission control through a window is in the implementation of any noise control techniques that do not sacrify the vision quality of the window, and are economical enough for mass production. In order to reduce noise transmission, grid-stiffened single-leaf windows are used, however, the use of grid-stiffeners will affect the vision quality of the windows. Some other techniques associating with noise reduction using acoustic resonators are also developed.

European patent to Serge and Eric (E. P. Pat No. 698753), discloses a sliding casement window which has a frame with inner and outer peripheral walls delimiting an inner free space and a peripheral opening. An acoustic resonator unit is disposed in this space. In this patent, the acoustic resonator unit is used to absorb the random impinging sound from outside environment and the transmitting sound in the room. However, since the acoustic resonator is only a narrow band noise control device, it cannot be guaranteed to always work at its resonance in this design, resulting in a low efficiency of noise absorption.

As known in the art, double-glazed windows have been also used for reducing noise transmission. Such windows generally comprise a pair of spaced glass sheets which a hermetically sealed together around their peripheral edges to form a dead-air space of chamber therebetween. Through introducing more mechanical filters, the sound insulation property of the double-glazed windows is significantly improved when compared with a normal single-leaf window. However, double-glazed windows are tied with an unacceptable noise transmission in low-frequencies.

Attempts have been also made in the past to overcome this problem. For example, United States patent to Eric et al. (U.S. Pat. No. 6,231,710) discloses a sandwiched cylindrical structure having a noise attenuation property, in which a Helmholtz resonator network is integrated into the sandwiched cylindrical shell to reduce the sound transmission. However, its potential of the Helmholtz resonator network using for noise transmission control in small enclosures like such a small air chamber inside the double-glazed window is limited because the bulb-like Helmholtz resonator will occupy more space and it is difficult to integrate into the windows without affecting the vision quality.

German patent to Jacobus (D.E. Pat. No. 3401996) discloses a sound-insulating double-glazed window having a circumferential acoustic resonator to control noise in low frequencies. The framework of the window consists of two pieces of frames having a U-shaped space in each, which will form the acoustic resonator body when they are connected, and the gap between the two connected frames forms the opening of the resonator. However, assembling such a window is labor-consuming since the framework includes more components than that of a regular double-glazed window, and in fabrication, more attenuation has to be paid on sealing treatments of the two connected frames, which form the acoustic resonator body and any leakage from it can disable the resonator. Moreover, the resonator used in this double-glazed window is actually a circumferential channel having a small gap, thus, the resonance frequencies of this resonator is difficult to design to target to the air-chamber resonances of interest.

It is an object of the present system to overcome the disadvantages and problems in the prior art.

DESCRIPTION

The present system proposes a window having a T-shaped acoustic resonator array structurally integrated in a window-spacer. The window provides a compact, economical, practical, and effective noise-reducing window system for noise insulation in broad or specific frequency band.

These and other features, aspects, and advantages of the apparatus and methods of the present invention will become better understood from the following description, appended claims, and accompanying drawings where:

Figure 7:
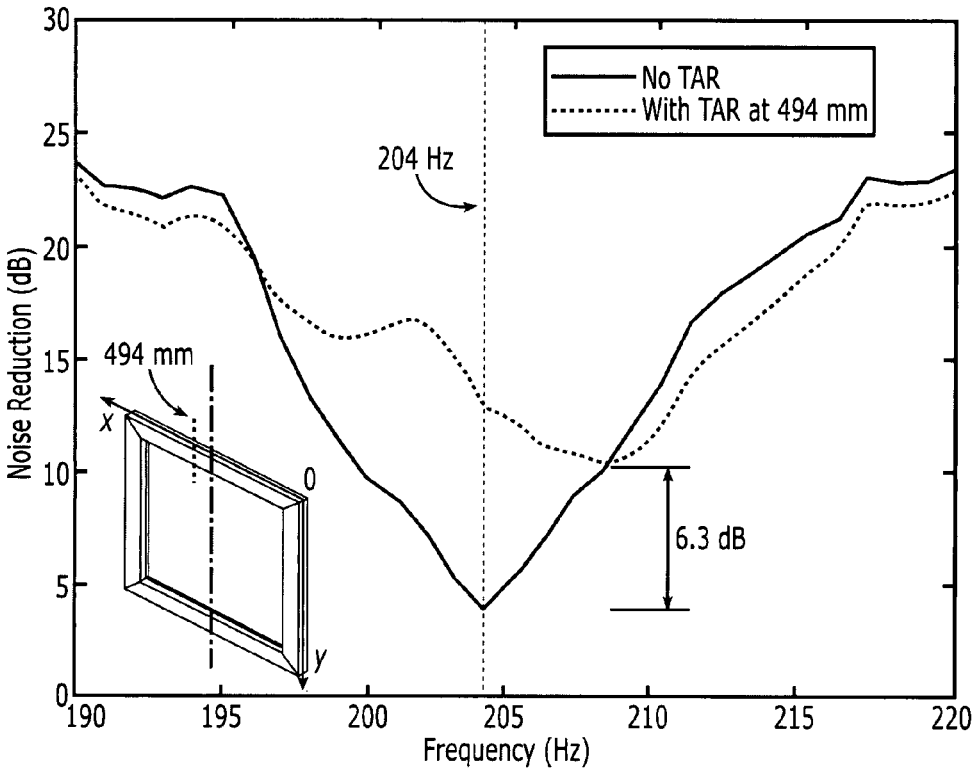

FIG. 7, exhibits the measured noise reduction of the window integrated with one T-Shaped acoustic resonator.

The following description of certain exemplary embodiment(s) is merely exemplary in nature and is in no way intended to limit the invention, its application, or uses.

Now, to FIGS. 1-7,

The window of the present invention includes two separated panes of glass arranged in parallel relationship, such panes being separated by a rectangular cross-sectional spacer extending around the peripheral edges of the panes, defining an interior air chamber therebetween, substantially impervious to the ambient atmosphere. When noise impinges to the external pane, the pane vibration can induce the resonance of the air chamber inside the window, which traps a large quantity of acoustic energy at the resonance frequencies. This energy can be effectively dissipated by using T-shaped acoustic resonators incorporated within the spacer.

The window is suitable for use in civil and industrial structures, wherever noise interferes with comfortable living and working environment. For example, buildings or offices near heavy traffic zones or airports can use the window to effectively reduce noise transmission into rooms.

Figure 1:
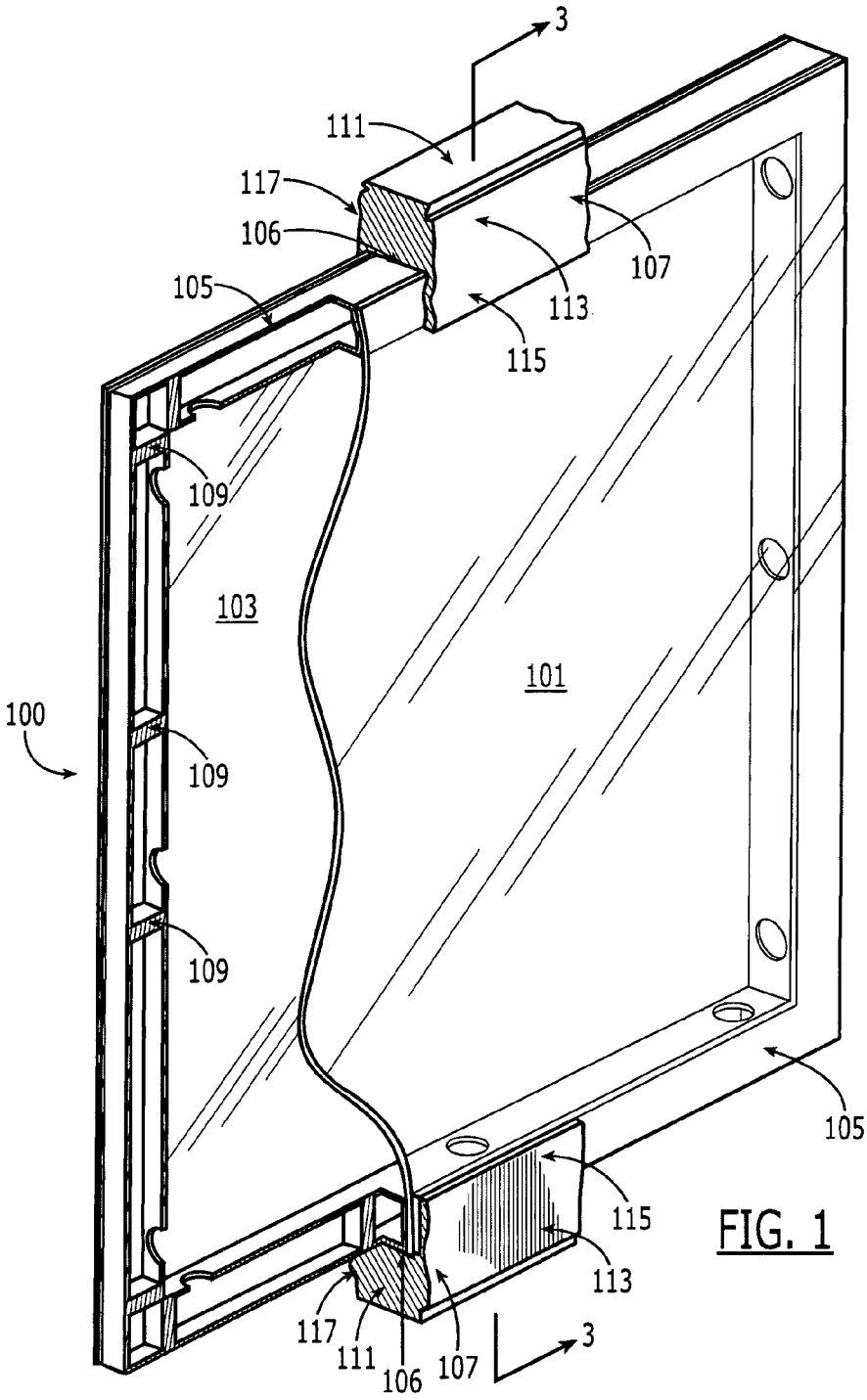
FIG. 1 shows a perspective view of the window of the present invention.

FIG. 1 shows a window 100 of the present invention, utilizing a rectangular cross-sectioned spacer frame integrated with a T-shaped acoustic resonator (TAR) array.

The window 100 generally includes two sheets of glass 101/103, arranged in spaced parallel facing relationship by a prefabricated hollow spacer frame 105 which extends around the peripheral margined facing edges of the glass 101/103, and each outer surface of the spacer frame 105. The adhesive also fills an outwardly facing channel enclosed by the outer surface of the spacer frame 105, the web 106 of the H-shaped frame 107, and the inner surfaces of the sheets 101/103. The spacer frame 105, together with the adhesive materials, defines a closed interior chamber between the facing surfaces of the glass 101/103.

The window 100 also includes end caps 109, formed using rubber, plastic, or cork plug fixed in with adhesive and curing. Before assembling spacer frame 105, resonators should be acoustically tuned and be located away from the nodes of the targeted modes. Therefore, the T-shaped acoustic resonators are integrated into the spacer frame 105.

Although components of the window 100 will be described as being compressibly held in assembly, it should be understood that window components can be held in assembled relationship by a series of clips or like devices (not shown) for being mounted as a unit in a structural building opening. As illustrated in the drawings, the frame is adopted to be mounted in an opening defined by wood sashes 111 of a building structure (not shown). More specifically, the marginal edges of the window 100 are positioned adjacent to a web 106 interconnecting the legs 113, 115, 117 of the H-shaped frame. The legs 115 compress glass sheets 101/103 against the spacer frame 105 through the adhesive, while the legs 113/117 supporting the window 100 in the sashes 111 mount the window 100 in the spaced relation thereto.

Although the invention will be described in conjunction with a rectangular window, it should be understood that the invention is equally adoptable to window units having other shapes, for example square, circular, triangular, etc.

Figure 2A:
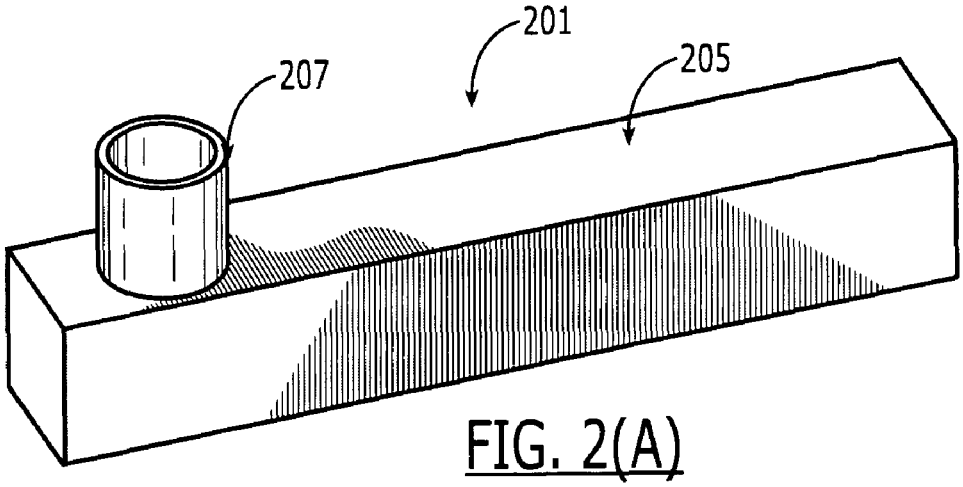
FIG. 2 shows embodiments of typical T-shaped resonators.
Figure 2B:
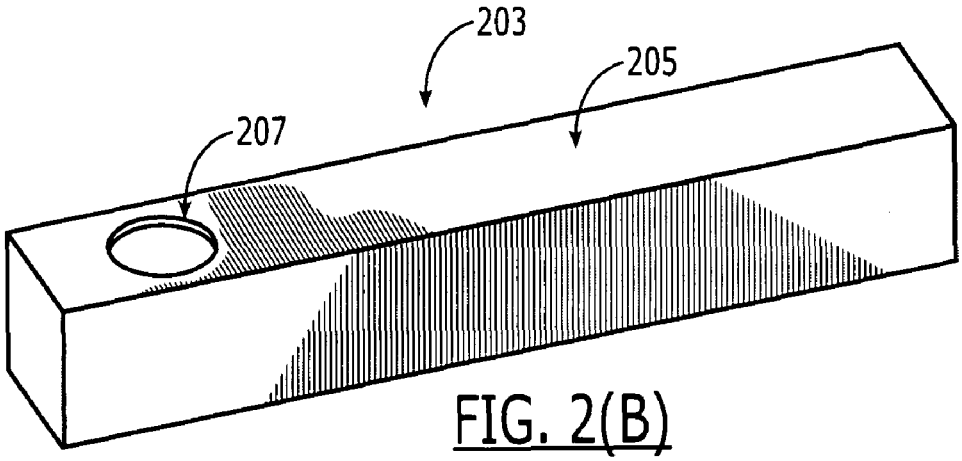

FIG. 2 is an illustration of embodiments of T-shaped acoustic resonators used in the present invention, having a rectangular body and circular neck perpendicular to the body. FIG. 2A, a specific neck is installed; FIG. 2B requires no specific neck.

Not to be bound theoretically, it is the basic concept of the present invention to use T-shaped acoustic resonators (TAR) 201 and 203 to control the modes of the air chamber (not shown) and thus alleviate noise corresponding to these modes. To this end, specifically designed TARs, either targeting a single mode for a narrow band noise control or multiple-modes with different resonance frequencies for a broadband noise control, are fabricated and integrated into the spacer frame. The long tube 205 of the resonator 201 and 203 is fabricated based on the hollow spacer frame; the short tube 207 of the resonator 203 is formed by drilling a hole on the surface of the spacer tube, having the same physical thickness as the walls of the tube.

Figure 3:
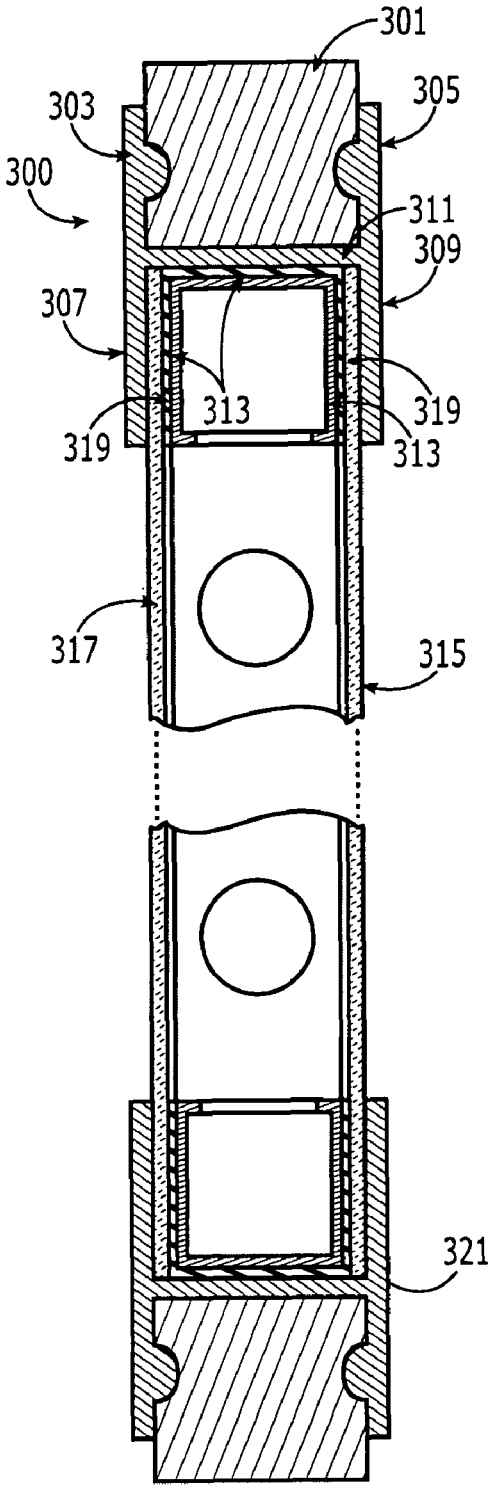
FIG. 3 shows a sectional view of the window.

FIG. 3 is an embodiment of the H-shaped frame 300 used with the window of the present invention.

The frame 300 is adopted for attachment to a sash 301 of the building structure. Attachment is brought about by legs 303, 305, 307 and 309, and a web 311. The H-shaped frame 300 can take a variety of shapes for example legs longer than other legs, without deviating from the scope of this present invention, in order to adopt to the form of the sash 301.

The bottom half of the frame 300 incorporates a spacer frame having outer surfaces 313 between which is held glass sheets 315/317 with a adhesive 319, which is disposed between the glazing sheets 315/317 and each outer surface 313 of the spacer.

An H-shaped frame is also used for the bottomside of the window, 321. The bottomside H-shaped frame 321 possesses the same elements as the topside H-shaped frame.

Figure 4:
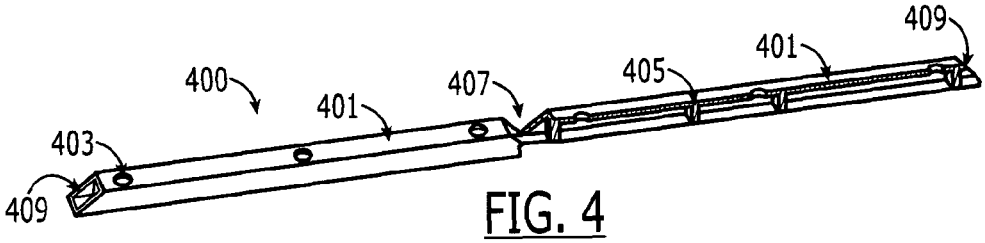
FIG. 4 shows half a spacer, integrating T-shaped acoustic resonators.

FIG. 4 shows an extended spacer tube 400 present invention. The spacer tube 400 is utilized to form a spacer frame. The spacer tube 400 is preferably fabricated from a substantially rigid material, for example metal, plastic, glass, or composites. Plastics have a desired heat transfer characteristic, but metal may be less expensive and easier to form during automated manufacturing. The length of the spacer tube 400 should be slightly smaller than the summation of the width and height of the glass.

T-shaped resonators 401, either targeting a single mode for a narrowband noise control or multiple-modes with different resonance frequencies for a broadband noise control, are fabricated and integrated into the spacer tube 400. The neck 403 of the resonator 401 is fabricated by drilling a hole on the surface of the spacer tube 400. Before assembly of the spacer tube 400, resonators 401 should be acoustically tuned and be located away from the nodes of the targeted modes.

The resonators 401 include end caps 405 formed from rubber, plastic, or cork fixed into the resonator 401 with adhesive and curing. The spacer tube 400 includes a cutout 407 for forming the frame of the spacer tube 400. Also included for forming the frame are connectors 409 on either side of the extended spacer tube 400. The connectors are used for connecting to other sides of an end cap, thus forming the complete spacer tube frame of 600.

Figure 5:
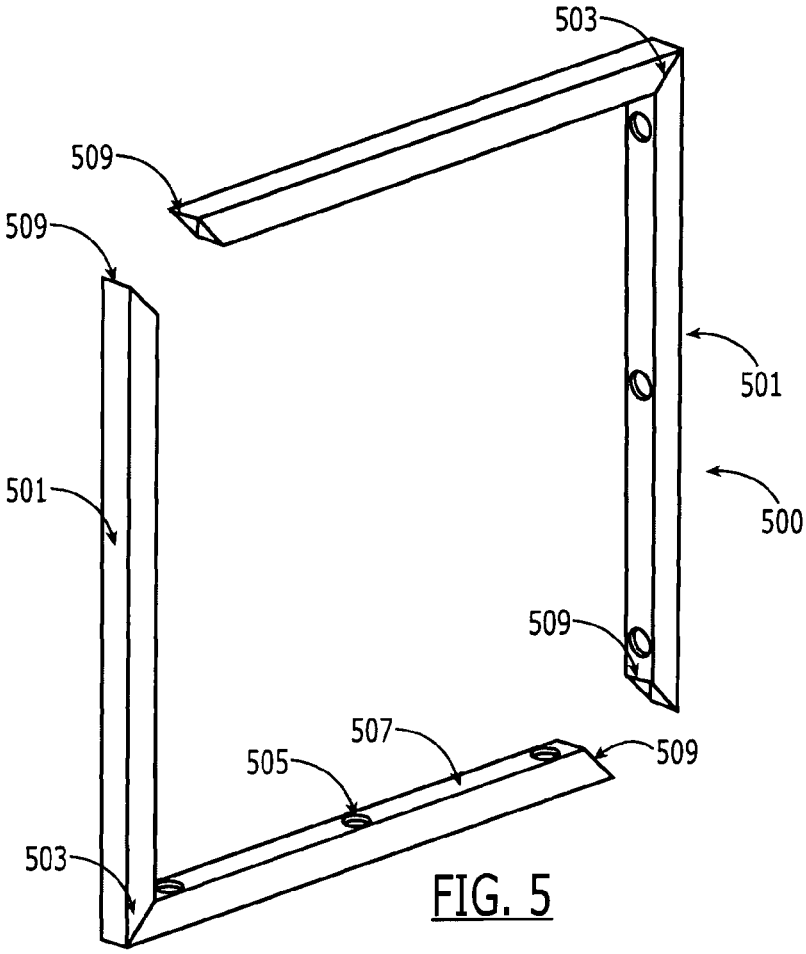
FIG. 5 shows the assembly method of the spacer component.

FIG. 5 shows a schematic side view of the assembly method of the spacer frame 500. The assembly method includes two spacer tubes 501 bent at the cutout 503 to a "L" formation. The spacer tubes 501 are made of resonators 507, wherein the resonators 507 possess necks 505.

The two spacer tubes 501 are attached at their connector ends 509, which can be held together by a variety of means, such as adhesion, welding, clamping, etc.

Figure 6:
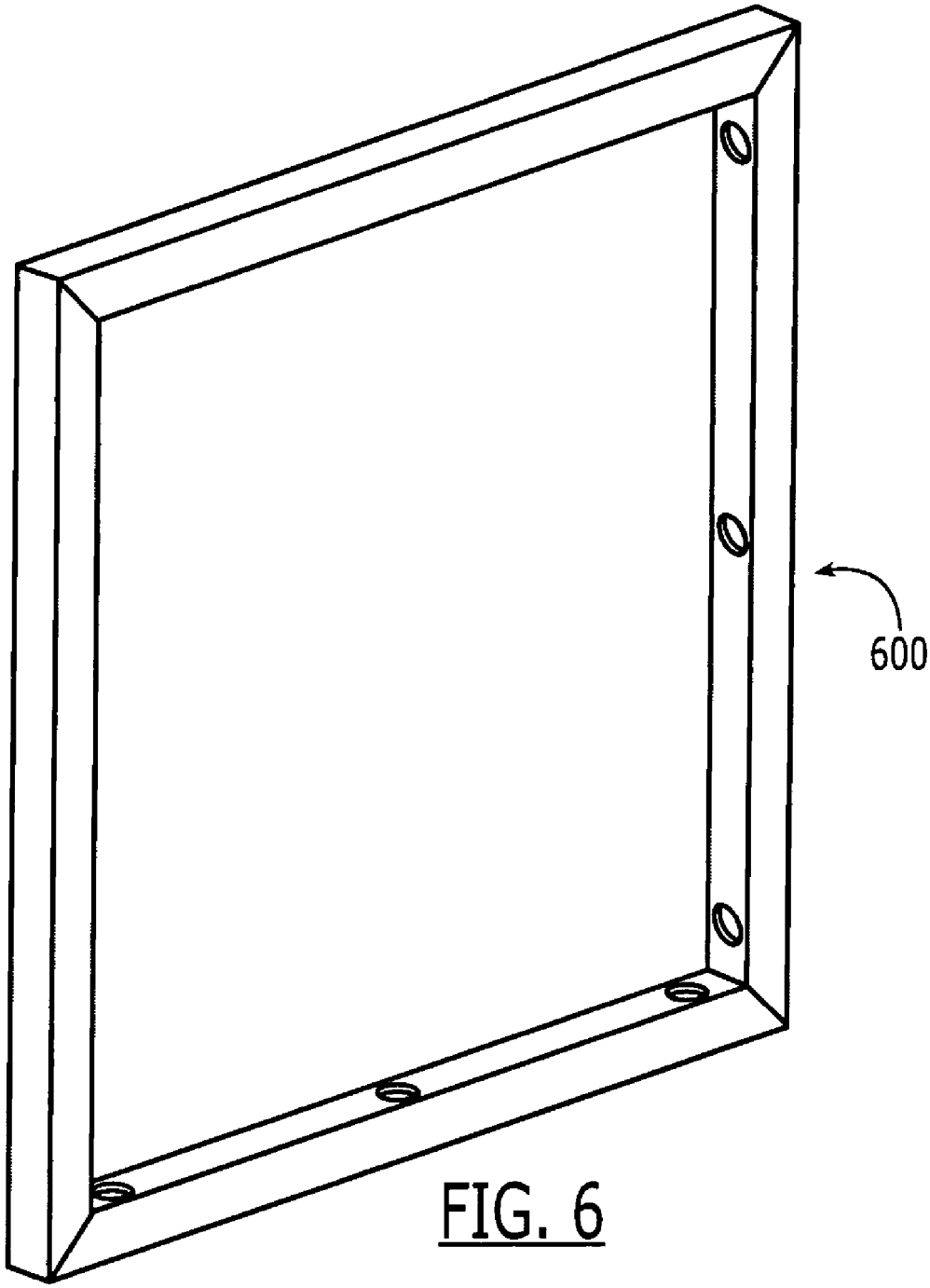
FIG. 6 shows the assembled spacer.

FIG. 6 shows the spacer frame 600 fully assembled.

A double-glazed window consisting of two 3 mm glass panels was fabricated to demonstrate the noise transmission control in the first resonance of the air chamber. The geometric dimensions of the air chamber enclosed between the two glass panels are 830×830×19 mm. One small T-shaped acoustic resonator, having Helmholtz frequency 204 Hz, was designed to target to the first acoustic chamber resonance peak with measured resonance frequency of 204 Hz. The body of the resonator was fabricated by a square cross-sectional aluminum tube with width×height=14.2×14.2 mm and the neck of the resonator was fabricated by a circular cross-sectional aluminum tube having inner diameter 7.7 mm and length 20 mm. The resonator was located at (x,y)=(494, 10) mm. The measured noise reduction (NR) are shown in FIG. 7. Measurements show a minimum 6.3 dB NR improvement around the targeted resonance peak.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A noise attenuating window, comprising a spacer frame;

two glass panes attached to opposite sides of the spacer frame;

a T-shaped acoustic resonator array embedded into the spacer frame; and an outer frame adapted to hold the spacer frame and the two glass panes, wherein the T-shaped acoustic resonator array includes a plurality of T-shaped resonators, and the T-shaped acoustic resonators in the array have more than one working resonance frequencies, and wherein each of the T-shaped resonators are separated by a pair of end caps, and at least two of the T-shaped resonators, with different working resonance frequencies, share the same end cap.

2. The noise attenuating window of claim 1, wherein said spacer frame is made of hollow tubes adapted to host the plurality of T-shaped resonators, and to separate the two glass panes.

3. The noise attenuating window of claim 1, wherein each of the T-shaped acoustic resonators comprises a long tube with two closed ends, and a short tube having two open ends, the long tube and the short tube are perpendicular to each other.

4. The noise attenuating window of claim 3, wherein each of the T-shaped acoustic resonators communicate through their open ends.

5. The noise attenuating window of claim 4, wherein the long tube is fabricated in the spacer frame.

* * * * *